United States Patent [19]

Hirsh

[11] Patent Number: 4,989,835

[45] Date of Patent: Feb. 5, 1991

[54] VEHICLE BARRIER

[75] Inventor: Robert A. Hirsh, Bethel Park, Pa.

[73] Assignee: The United States of America as represented by the United States Department of Energy, Washington, D.C.

[21] Appl. No.: 181,993

[22] Filed: Apr. 15, 1988

[51] Int. Cl.[5] ..... E01F 13/00

[52] U.S. Cl. ..... 256/13.1; 404/6; 49/9; 49/34

[58] Field of Search ..... 256/13.1, 35, 23; 404/6, 9; 49/9, 49, 34, 35; 246/293

[56] References Cited

U.S. PATENT DOCUMENTS

| | | | |
|---|---|---|---|
| 1,709,344 | 4/1929 | Gage et al. | 49/9 |
| 1,848,516 | 3/1932 | Davison | 49/9 |
| 2,263,649 | 11/1941 | Sawyer | 256/13.1 X |
| 2,317,248 | 4/1943 | Brickman . | |
| 2,326,547 | 8/1943 | McNabb | 256/13.1 |
| 3,210,051 | 10/1965 | Case . | |
| 3,717,326 | 2/1973 | Leach . | |
| 3,839,824 | 10/1974 | Ellis . | |
| 3,876,973 | 4/1975 | Griebel | 49/49 X |
| 3,990,182 | 11/1976 | Linder . | |
| 4,183,505 | 1/1980 | Maestri . | |
| 4,480,405 | 11/1984 | Ferguson | 49/34 X |
| 4,501,411 | 2/1985 | Otaki . | |
| 4,576,507 | 3/1986 | Terio | 404/6 |
| 4,658,543 | 4/1987 | Carr | 49/49 X |
| 4,759,655 | 7/1988 | Gorlov | 49/9 X |
| 4,780,020 | 10/1988 | Terio | 404/6 |
| 4,818,137 | 4/1989 | Gorlov | 49/49 X |
| 4,844,653 | 7/1989 | Dickinson | 404/6 |

FOREIGN PATENT DOCUMENTS

| | | | |
|---|---|---|---|
| 2178094 | 2/1987 | United Kingdom | 49/9 |

*Primary Examiner*—Peter M. Cuomo

*Attorney, Agent, or Firm*—James C. Haight; William R. Moser; Richard E. Constant

[57] ABSTRACT

A vehicle security barrier which can be conveniently placed across a gate opening as well as readily removed from the gate opening to allow for easy passage. The security barrier includes a barrier gate in the form of a cable/gate member in combination with laterally attached pipe sections fixed by way of the cable to the gate member and lateral, security fixed vertical pipe posts. The security barrier of the present invention provides for the use of cable restraints across gate openings to provide necessary security while at the same time allowing for quick opening and closing of the gate areas without compromising security.

6 Claims, 2 Drawing Sheets

VEHICLE BARRIER

BACKGROUND OF THE INVENTION

The present invention relates to a vehicle cable barrier, and more specifically to a cable/gate barrier placed across a gate opening or vehicle path.

Due to the increased terrorist activity throughout the world improved systems are necessary so as to increase the security with respect to readily accessible areas to vehicle traffic. Many various forms of barriers have been suggested so as to retard or stop the advancement of vehicles either from a safety, traffic control or security point of view. There has been suggested the use of posts pivotally anchored by energy absorption devices with cables supported sideways on the posts and energy absorption devices located at selected points along the cable whereby upon receiving impact from an automobile the energy imparted to the cable and posts is absorbed by the energy absorption devices thus stopping the progress of the vehicle. Conventional guard rails used for stopping automobiles include iron or steel posts driven into the ground at a constant pitch and steel strips or wire ropes attached so as to connect the posts. Chains suspended between posts or a double length of chain appropriately locked have also been suggested as a form of security for preventing ingress of unauthorized vehicles into private areas. However, in utilizing the various sundry techniques discussed above for preventing access to specified areas by motorized vehicles in most instances all of these presently known systems have been found to be somewhat deficient in achieving the desired results of providing the necessary security. Heretofore proposed security gates have been found lacking in achieving reliable and control and, if necessary, total prevention of the movement of motorized vehicles. Cables or posts alone do not prevent vehicle penetration. Therefore, reliable security devices are necessary in order to provide for complete protection from unwanted intrusion.

SUMMARY OF THE INVENTION

Therefore, it is an object of the present invention to provide a security system which will overcome the above-noted disadvantages.

It is a further object of the present invention to provide a basic design which will enable the reliable prevention of the intrusion of motorized vehicles into selected areas.

Another object of the present invention is to provide a cable/gate barrier configuration which is capable of withstanding a vehicle impact of an extreme force.

The foregoing objects and others are accomplished in accordance with the present invention generally speaking by providing a barrier gate which comprises a combination of pipe sections, gate arm, and cables together forming a reliable vehicle cable barrier which, when placed across a selected gate opening, reliably prevents or stops further entry of a vehicle. The barrier generally comprises two cables attached respectively to pipe sections which are bolted to a conventional gate mechanism inclusive of a gate arm. When the gate is dropped or lowered into position across a gate opening or vehicle path the gate arm flanked by the cables, is positioned or placed between two sets of pipe posts at respective ends of the gate arm spaced from each other so as to permit the gate arm to pass therebetween. The distance between the two pipes of each set of pipe posts is less than the total dimension of the diameter of the pipe sections to which the cables are attached and two thicknesses of the attached cables such that upon impact the pipe sections will not be drawn through the space between the respective pipe posts. Preferably the cable makes two turns around the respective pipe section to which it is affixed in order to develop the desired strength of the cables and the combination cable/gate barrier. The configuration of the present invention solves the problem of placing vehicle cable restraints across gate openings or vehicle paths to provide the necessary security, while satisfactorily permitting quick opening and closing of the gate areas without sacrificing security.

BRIEF DESCRIPTION OF THE DRAWINGS

The invention is further explained by way of the accompanying illustrations wherein.

DETAILED DESCRIPTION

Figure 1:
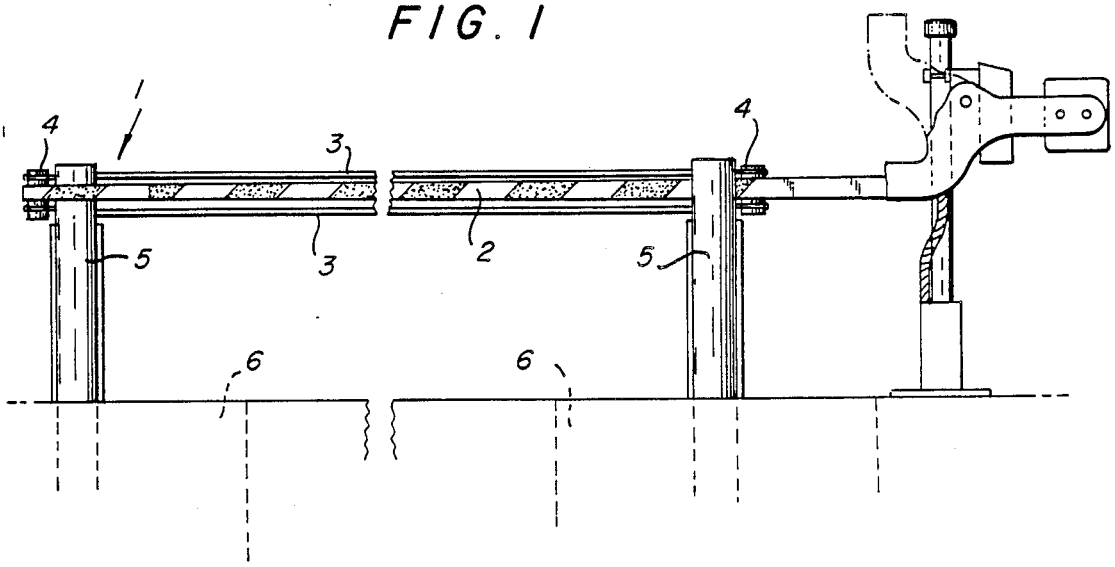
FIG. 1 represents a side vie of the cable/gate barrier of the present invention in place to provide the security barrier.

Referring now to FIG. 1 there is seen the cable/gate barrier of the present invention in the closed condition so as to provide the complete security barrier generally designated 1. The cable/gate configuration comprises a gate arm 2 flanked above and below by ¾" diameter cables or wire rope 3, juxtapositioned to the gate 2. In the case of the present illustration, the wire ropes or cables are attached at both lateral extremities to cable connection means or 4" diameter pipe sections 4 and the gate arm 2 is attached to a conventional railroad-type crossing gate mechanism. In the illustrated closed position the gate arm, flanked by the respective cables, is lowered into position, at the ends thereof between two sets, respectively, of 8" pipe posts 5. The two pipes of each set are spaced apart in the case of the instant illustration up to about 3", each pipe post being substantially anchored in a base support 6 and positioned medial to, with respect to the center of the gate arm, and in close proximity with the respective pipe sections 4 about which the cables 3 are wound. In order to develop the full strength of the cables when securing the ends of the cables it is preferred that the cable be wrapped with two turns around the 4" pipe section with the terminal or dead end of the cable being affixed to the live end of the cable. This attachment configuration will be further discussed below with respect to FIG. 4. When a vehicle impacts the barrier 1, the gate arm 2 can be expected to break away from the gate mechanism and the cables 3 placed in tension. The space existing between the anchoring pipe posts will always be designed such that it will be less than the diameter of the respective pipe sections plus two thicknesses of the cable. Thus, upon impact the pipe sections will not be drawn through the space between the pipe posts so that the cables will stop the progress of the vehicle.

Figure 2:
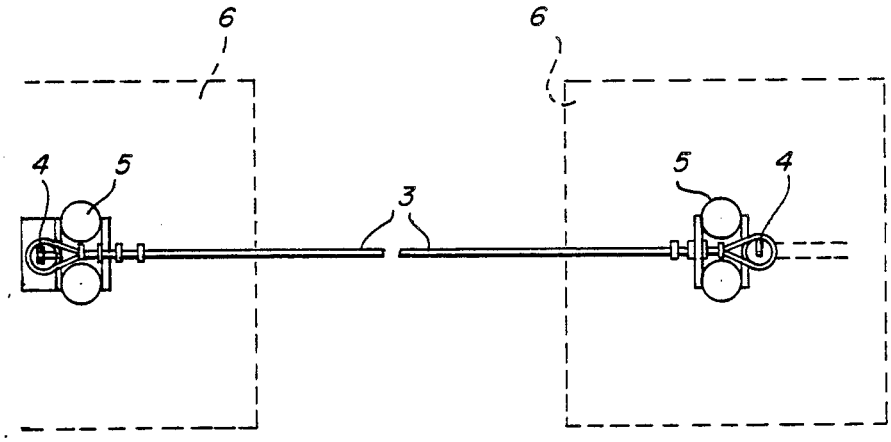
FIG. 2 represents a top view of the cable/gate barrier of the present invention of FIG. 1.

Referring now to FIG. 2 the security barrier configuration of FIG. 1 is seen from a top view. The base support or concrete footer 6 provides the foundation for the respective sets of anchoring pipe posts 5. The relationship between the respective pipe sections 4 and the spacing between the pipe posts 5 can be most readily seen in FIG. 2.

Figure 3:
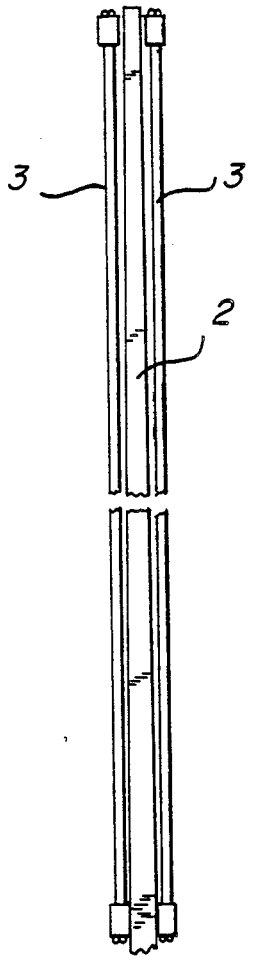
FIG. 3 represents the cable/gate barrier of FIG. 1 in the open position from a front perspective.

FIG. 3 illustrates the condition whereby the cable/-gate member is raised to its open or upright position so as to allow for the unobstructed passage of a vehicle. The barrier gate of the present invention would be electrically, automatically operated by a guard in a nearby gate house or guard station. The specific cable/-gate configuration and mechanism of the present invention allows for raising and lowering of the barrier without sacrificing security.

Figure 4:
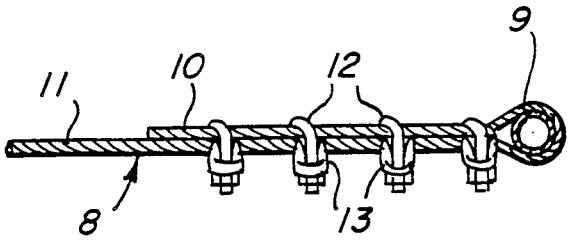
FIG. 4 illustrates the manner in which the cable in attached to the pipe sections of the cable/gate structure of the present invention.

Referring now to FIG. 4 there is seen in an enlarged section the manner in which the cable or wire rope is attached to the pipe section. A cable or wire rope 8 is wound in two turns around a pipe section 9 and the terminal or dead end 10 of the rope 8 bolted to the live end 11 by way of the U-bolts 12, and the saddle 13.

The installation of the cable vehicle barrier of the present invention is one of the less complicated ways of upgrading perimeter fence lines against a vehicle threat. If existing fences and gates are of sound construction and proper installation the addition of the wire rope cable provides a substantial barrier against vehicles attempting forcible overt penetration of an area. The installation of cables to an existing or new fence or gate depends heavily on the strength of the basic fence design. That is, the vertical line posts, footers, and fence fabric used in combination with the gate, soil, and other fence elements. All of these fence/gate components contribute to the strength of the barrier. The introduction of properly sized and installed cables not only adds individual strength to the structure but also ties the elements together such that upon impact all of the fence components gradually dissipate the kinetic energy of the vehicle attempting to penetrate a site perimeter. It is not the cable alone which prevents the vehicle penetration but the combination of the cable together with all of the respective components.

The selection of the particular cable to be used can vary depending upon whether or not the security barrier is prepared anew or whether a pre-existing fence is to be reinforced by the installation of the wire rope cable. In accordance with the above illustrations a ¾" diameter cable has been used to describe the security barrier of the present invention. However, depending upon the threat, the cable size or number can change significantly. For example, a single ¾" diameter cable mounted on a typical mesh fabric fence can stop a 4,000 pound vehicle traveling at 50 miles per hour after impacting at 90° a fence with a single or a dual cable/post barrier. This translates into 334,000 foot pounds of vehicle kinetic energy. A similar configuration comprising two ¾" diameter cables mounted on line posts without a fence fabric stopped a 4,000 pound vehicle traveling at 52 miles per hour, which is a slightly higher energy level. Increasing the number of cables appears to slow down or stop higher vehicle threats provided that the related posts and foundations are also designed to address the higher threat. Because a threat vehicle's energy is directly proportional to the square of the impact velocity, in addition to its mass, measures should be taken to reduce all approaching velocities.

The cable used with respect to the above data was a ¾" diameter 6×19 (strands by wires per strand) with an independent wire rope core (IWRC). The 6×19 IWRC was made from improved plow steel having a breaking strength of 58,800 pounds. This size and type of cable was selected because it provided both flexibility for handling during installation and crush and breaking strength during vehicle impact. Galvanized cable could also be used where possible to avoid degradation of cable strength due to corrosion.

The cable installation height on a fence will be dictated by the height of the threat vehicle. However, most recommended heights for a single cable range from 27 to 30 inches above the ground for standard size vehicles and light trucks. A dual cable vehicle barrier consisting of only vertical line posts with large footings, two ¾" diameter cables and deadman anchors at both ends have demonstrated that a 4,000 pound vehicle could be stopped traveling at slightly over 50 miles per hour. In the case of the dual cable configuration the cable heights were 30 inches and 35 inches above the ground, respectively. A vehicle's frame, bumper, tire diameter, center of gravity, etc., all influence the cable height utilized.

Conventional cable attachments are utilized to affix the cable to the pipe sections such as simple U-bolts or wire rope clips. At vehicle impact the use of these items secures the cable vehicle barrier by preventing the cable from slipping over the vehicle and preventing the vehicle from running over the cable.

The structure of the present invention can be utilized as part of a vehicle trap at a gate. The structure would be placed at the inside end of a corridor lined on both sides with pipe columns so that any vehicle that comes in through a gate must wait until this barrier is lifted before proceeding into a secured area.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A security barrier comprising:

first and second spaced post assemblies which define a passageway therebetween for a vehicle, each post assembly comprising a pair of pipe posts substantially anchored in a base support to define a space therebetween such that upon impact a cable connection means will not be drawn through the space between the two pipe posts;

an elongated gate arm pivotally and separately supported at a first end portion, which is disposed adjacent to and spaced from the pipe posts of said first post assembly, to rotate between a lowered position in which the gate arm extends between the pipe posts of said first and second post assemblies so that a second end portion of the gate arm is disposed adjacent the pipe posts of said second post assembly to block the passage of a vehicle through the passageway, and a raised position in which the gate arm is pivoted away from the pipe posts of said first and second post assemblies to allow a vehicle to pass through the passageway;

an elongated cable supported along and extending from said first end portion of said elongated gate arm to said second end portion of said elongated gate arm;

cable connection means attached to said first and second end portions of said gate arm for securing end portions of said cable to said gate arm and operating to engage the pipe posts of said first and second post assemblies when a vehicle moves into the passageway, thereby contacting and deflecting said gate arm and said cable when the gate arm is in the lowered position.

2. The security barrier according to claim 1, wherein said gate arm is a rigid member and said cable connection means are disposed on opposite sides of the pipe posts of said first and second post assemblies from the passageway when said gate arm is in the lowered position so that when portion of said cable in the passageway is deflected, said cable connection means moves toward the pipe posts of the post assemblies.

3. The security barrier according to claim 1, wherein the pipe posts of said first and second post assemblies are located between said first and second end portions of said gate arm and said cable connection means when said gate arm is in the lowered position.

4. A security barrier comprising:

first and second post assemblies which are spaced apart to define a passageway therebetween for a vehicle, wherein each post assembly comprises a pair of posts which are substantially anchored in a base support and spaced apart to define a space therebetween;

an elongated gate arm pivotally supported at a first end portion to rotate between a lowered position in which the gate arm is supported in the space between the pair of posts of each post assembly so that the first end portion of the gate arm is located adjacent the pair of posts of the first post assembly and the second end portion of the gate arm is located adjacent the pair of posts of the second post assembly, and a raised portion in which the gate arm is pivoted upwardly from the first and second post assemblies;

an elongated cable extending from the first end portion of the gate arm to the second end portion of the gate arm and passing through the spaces defined between the pair of posts of the first and second post assemblies;

cable connection means attached to the first and second end portions of the gate arm for securing end portions of the cable to the gate arm and operating to engage the pair of posts of at least one of the first and second post assemblies with portions of the elongated cable and the gate arm disposed between the first and second spaced post assemblies are deflected.

5. The security barrier according to claim 4, wherein said cable connection means comprises a pipe section attached to the first and second end portions of the gate arm and the end portions of the cable, wherein each pipe section has a cross-section dimension which is greater than the space between the pair of posts of each post assembly.

6. The security barrier according to claim 4, wherein the first and second post assemblies are located between the cable connection means when the gate arm is in the lowered position and the cable connection means is configured to become lodged in the space between the pair of posts of the first and second post assemblies when portion of the cable in the passageway is deflected.

* * * * *